US007887350B2

(12) United States Patent
Fukazawa et al.

(10) Patent No.: US 7,887,350 B2
(45) Date of Patent: Feb. 15, 2011

(54) FLOATING CONNECTOR WITH A FIXTURE TO LIMIT VERTICAL MOVEMENT OF THE CONNECTOR

(75) Inventors: Takeki Fukazawa, Tokyo (JP); Masato Hida, Tokyo (JP); Takanobu Yoshimi, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 12/546,565

(22) Filed: Aug. 24, 2009

(65) Prior Publication Data

US 2010/0055952 A1 Mar. 4, 2010

(30) Foreign Application Priority Data

Aug. 27, 2008 (JP) ..... 2008-217519

(51) Int. Cl.
*H01R 13/64* (2006.01)

(52) U.S. Cl. ..... 439/247

(58) Field of Classification Search ..... 439/247, 439/248, 660, 74, 570
See application file for complete search history.

(56) References Cited

U.S. PATENT DOCUMENTS 4,812,133 A * 3/1989 Fleak et al. ..... 439/248
5,259,779 A * 11/1993 Ooya et al. ..... 439/247
5,306,168 A * 4/1994 Kunishi et al. ..... 439/248
2006/0276061 A1* 12/2006 Koguchi et al. ..... 439/74
2009/0239422 A1* 9/2009 Fukazawa et al. ..... 439/660

FOREIGN PATENT DOCUMENTS

JP 2002-42937 2/2002
JP 2002-352908 12/2002
JP 2003-45525 2/2003

* cited by examiner

*Primary Examiner*—Chandrika Prasad
(74) *Attorney, Agent, or Firm*—Finnegan, Henderson, Farabow, Garrett & Dunner, L.L.P.

(57) ABSTRACT

A fixture for a floating connector is to be mounted on a substrate and has at one end a connection portion to be connected to the substrate. The two fixtures are used in the floating connector including a plurality of contacts, an insulator fixing the contacts therein and having flanges, and a housing covering the insulator and fixing the contacts therein. The fixtures each include at the other end an anchoring bent piece adapted to engage the flange of the insulator to prevent the insulator from floating upwardly to an excessive extent. The floating connector using the fixtures is able to completely prevent the contacts from being buckled or deformed to an excessive extent when the floating connector is being fitted with or removed from a mating connector.

17 Claims, 3 Drawing Sheets

FLOATING CONNECTOR WITH A FIXTURE TO LIMIT VERTICAL MOVEMENT OF THE CONNECTOR

BACKGROUND OF THE INVENTION

This invention relates to a fixture for a floating connector for use in an electric or electronic appliance for industrial machines, car navigation systems, and the like, and more particularly to a floating connector using the fixtures, capable of fitting with and removing from a mating connector without buckling and deformation of contacts to an excessive extent.

In hitherto used electrical connectors having a floating part, two insulators have often been used, either of which is supported only by contacts each having an elastic portion which is elastically deformable. In order to provide an elasticity to contacts, it has been employed that the elastic portions are snaked or tortuous, or contacts are elongated by increasing a distance between two insulators.

As prior art floating connectors, incorporated herein are Japanese Patent Application Opened No. 2002-42,937 (Patent Literature 1), Japanese Patent Application Opened No. 2002-352,908 (Patent Literature 2), and Japanese Patent Application Opened No. 2003-45,525 (Patent Literature 3), these being proposed by the applicant of the present case.

Patent Literature 1

According to the abstract of the Japanese Patent Application Opened No. 2002-42,937, this invention has an object to provide an electrical connector 1consisting of a pin connector 10 and a socket connector 20 whose respective contacts 14 and 24 are not subjected to any load so that no defective or failed connection occurs when a substrate 60 is fixed to a casing in a state that the pin connector 10 and the socket connector 20 are fitted with each other. Disclosed is an electrical connector 1 consisting of a pin connector 10 and a socket connector 20detachably fitted with each other, including a locator 40 having a groove portion 42of a size accommodating the socket connector 20 and having engaging means for engaging the socket connector 20 so that the socket connector 20 is mounted on the locator 40 and is fixed to a substrate 60 so as to be floating. Moreover, lengths of socket contacts 24 received in the locator 40 are 5 to 10 mm, thereby giving the socket connector 20 floating function.

In connection with the above description, claim 1 of the Japanese Patent Application Opened No. 2002-42,937 recites an electrical connector consisting of a pin connector and a socket connector detachably fitted with each other, said pin connector comprising a required number of pin contacts and a block for holding and fixing the pin contacts, and said socket connector comprising a required number of socket contacts adapted to contact said pin contacts and a housing for holding and fixing said socket contacts, said electrical connector comprising a locator having a groove portion of a size accommodating said socket connector and having engaging means for engaging said socket connector so that said socket connector is mounted on said locator and is fixed to a substrate in a manner that said socket connector is movable in a floating state. Claim 2 recites the electrical connector as claimed in claim 1, wherein lengths of said socket contacts received in said locator are 5 to 10 mm so that said socket connector has a floating function. Claim 3 recites the electrical connector as claimed in claim 1, wherein said locator is provided with a continuous groove in which the socket contacts of said socket connector can be displaced, thereby providing a floating function to said socket connector. Claim 4recites the electrical connector as claimed in claim 2, wherein said socket contacts are bent substantially at right angles or twisted in a continuous groove of said locator. Claim 5 recites the electrical connector as claimed in claim 2, wherein said socket contacts are curved in a continuous groove of said locator.

Patent Literature 2

According to the abstract of the Japanese Patent Application Opened No. 2002-352,908, the invention has an object to provide a connector 10 or 40 having a floating structure in a simple construction without increasing the number of parts, and enabling connection portions of contacts to be positioned. Disclosed is a connector 10 or 40 including contacts 14 or 44 each having a contact portion 32adapted to contact a mating contact, a fixed portion 34 to be fixed to a block 12 or 42, and a connection portion 22 to be connected to a substrate; and the block 12 or 42 for holding and fixing the required number of the contacts 14 or 44, wherein the contacts 14 or 44 are each provided with an elastic portion 20 or 50 between the fixed portion 34 and the connection portion 22, and a substantially box-shaped housing 16 or 46 with clearances relative to outer dimensions of the block 12 or 42is provided on the side of the connection portions of the contacts 14 or 44 so as to enable positioning of the connection portions 22 of the contacts relative to the substrate and to enable floating of the connector 10 or 40. In order to make easy the floating, moreover, the elastic portion 20 or 50 of each of the contacts 14 or 44 is preferably snaked at least one location.

In connection with the above description, claim 1 of the Japanese Patent Application Opened No. 2002-352,908 recites a connector to be mounted on a substrate, including contacts each having a contact portion adapted to contact a mating contact, a fixed portion to be fixed to a block, and a connection portion to be connected to said substrate; and the block for holding and fixing the required number of the contacts, wherein said contacts each comprise an elastic portion between the fixed portion and the connection portion and a substantially box-shaped housing with clearances relative to outer dimensions of said block is provided on the side of the connection portions of said contacts so as to enable positioning of the connection portions of said contacts relative to the substrate and to enable floating of the connector. Claim 2 recites the connector as claimed in claim 1, wherein each of the elastic portions of said contacts is snaked at least one location. Claim 3recites the connector as claimed in claim 2, wherein said contacts are each provided with a cross-shaped positioning portion between the elastic portion and the connection portion. Claim 4 recites the connector as claimed in claim 3, wherein said housing is provided with a required number of inserting grooves on the side of connection to the substrate for inserting said contacts thereinto, and between the respective inserting grooves plate-shaped members are arranged, and wherein said plate-shaped members are each provided with a protrusion on one side and with a guide surface on the other side, and further provided with inclined surfaces A and B continuous to said guide surface, and provided with an inclined portion continuous to and substantially perpendicular to said inclined surface A. Claim 5 recites the connector as claimed in claim 4, wherein said contacts are each installed in the housing by steps of inserting the contact into the housing with the tip of a cross-shaped positioning portion to be guided along the guide surface, moving the contact so as to guide the tip along the inclined portion and the inclined surface A toward the protrusion, and further moving the contact so as to guide the tip along the inclined surface B to the protrusion so that the cross-shaped positioning portion of said contact is seated on the protrusion and an installed portion.

Patent Literature 3

According to the abstract of the Japanese Patent Application Opened No. 2003-45,525, the invention has an object to provide a connector 10 having a floating structure in a simple construction without increasing the number of parts, and enabling connection portions of contacts to be positioned. Disclosed is a connector 10 including contacts 14 each having a contact portion 32 adapted to contact a mating contact, a fixed portion 34 to be fixed to a block 12, and a connection portion 22 to be connected to a substrate; and the block 12 for holding and fixing the required number of the contacts 14, wherein the contacts 14 are each provided with an elastic portion 20 having at least one snaked portion between the fixed portion 34and the connection portion 22, and a substantially box-shaped housing 16 with clearances relative to outer dimensions of the block 12 is located outside the block 12 on the side of the connection portions of the contacts 14 so as to enable positioning of the connection portions 22 of the contacts relative to the substrate and to enable floating of the connector 10. Moreover, the contacts are each preferably 15 provided between the elastic portion 20 and the connection portion 22 with fitting portions 21 adapted to engage in an inserting hole 36 of said housing 16.

In connection with the above description, claim 1 of the Japanese Patent Application Opened No. 2003-45,525 recites a connector to be mounted on a substrate, including contacts each having a contact portion adapted to contact a mating contact, a fixed portion to be fixed to a block, and a connection portion to be connected to said substrate; and the block for holding and fixing the required number of the contacts, wherein said contacts each comprise an elastic portion having at least one snaked portion between the fixed portion and the connection portion, and a substantially box-shaped housing with clearances relative to outer dimensions of said block is located outside said block on the side of the connection portions of said contacts so as to enable positioning of the connection portions of said contacts relative to the substrate and to enable floating of the connector. Claim 2 recites the connector as claimed in claim 1, wherein said housing is provided on its width ends with slits in the proximities of arms so as to provide elasticity to the arms to facilitate engagement of locks of the block. Claim 3 recites the connector as claimed in claim 2, wherein said contacts are each provided between the elastic portion and the connection portion with a fitting portion adapted to engage an inserting hole of said housing.

In case of connectors, in general, a force for removing one connector from the other connector fitted with each other may be indicated by a product of a contact force at each contact and the number of the contacts: With the constructions disclosed in the Patent Literatures described above, in order to realize the floating of the connector, two insulators are used, either of which is held only by contacts each having an elastically deformable elastic portion (by providing a partly snaked or tortuous portion or by elongating a distance between the two insulators). However, there is a risk of the elastic portions of the contacts deforming to an excessive extent so that the elastic portions could not be restored to their original shapes.

With the constructions described above, moreover, when a mating connector is being fitted in a connector, as either of insulators in a floating state is pushed, there is also a possibility of buckling of the elastic portions exceeding their elastic limits.

SUMMARY OF THE INVENTION

In view of such problems of the prior art described above the invention has been completed, and the invention has an object to provide a floating connector capable of fitting with and removing from a mating connector without any risk of contacts being buckled or deformed to an excessive extent, with the aid of fixtures for the floating connector.

The object of the invention can be accomplished by the fixture for a floating connector, to be mounted on a substrate, having at one end a connection portion to be connected to said substrate, and being used in the floating connector including a plurality of contacts, an insulator fixing said contacts therein and having flanges, and a housing covering said insulator and fixing said contacts therein, according to the invention said fixture comprising at the other end an anchoring bent piece adapted to engage said flange of the insulator to prevent said insulator from floating upwardly to an excessive extent.

The fixture for a floating connector claimed in claim 2 is constructed in that in the fixture claimed in claim 1, said fixture further comprises a second anchoring bent piece between said connection portion and said anchoring bent piece so that said anchoring bent piece and said second anchoring bent piece are located above and below said flange of the insulator for limiting the floating of said insulator in the direction of its height and preventing said insulator from being seated at the lowest position.

The fixture for a floating connector claimed in claim 3 is constructed in that in the fixture claimed in claim 1, said fixture further comprises a second anchoring bent piece between said connection portion and said anchoring bent piece so that said anchoring bent piece and said second anchoring bent piece are located above and below said flange of the insulator, and said fixture further comprises projecting portions located on both sides of said anchoring bent piece between said anchoring bent piece and said second anchoring bent piece and projecting at right angles to said anchoring bent piece for preventing said fixture from falling down.

Further, the object of the invention can be achieved by the floating connector including a plurality of contacts each having a contact portion adapted to contact a mating object, a first fixed portion to be fixed to an insulator, a second fixed portion to be fixed to a housing, an elastic portion provided between said first fixed portion and said second fixed portion and having at least one snaked portion, and a first connection portion to be connected to a substrate; the insulator arranging and fixing said contacts, having flanges, and being supported only by said contacts so as to be in a floating state in said housing; and the housing covering said insulator and arranging and fixing said contacts, and as claimed in claim 4 said floating connector using the fixtures claimed in any one of claims 1 to 3.

As can be seen from the above description, the fixture and the floating connector using the fixtures according to the invention can bring about the following significant functions and effects.

(1) The fixture for a floating connector claimed in claim 1 is a fixture to be mounted on a substrate, having at one end a connection portion to be connected to said substrate, and being used in the floating connector including a plurality of contacts, an insulator fixing said contacts therein and having flanges, and a housing covering said insulator and fixing said contacts therein, said fixture comprising at the other end an anchoring bent piece adapted to engage said flange of the insulator to prevent said insulator from floating upwardly to an excessive extent. Accordingly, the invention can provide a floating connector capable of preventing the insulator from floating upwardly to an excessive extent when a mating connector is being removed from the connector and capable of avoiding the contacts from being buckled or extremely deformed when fitting with and removing from the mating connector.

(2) According to the fixture for a floating connector claimed in claim 2, said fixture further comprises a second anchoring bent piece between said connection portion and said anchoring bent piece so that said anchoring bent piece and said second anchoring bent piece are located above and below said flange of the insulator for limiting the floating of said insulator in the direction of its height and preventing said insulator from being seated at the lowest position. Therefore, the invention can provide a floating connector capable of limiting the floating amount in the direction of height and preventing the insulator from being seated at the lowest position, and capable of avoiding the contacts from being buckled or extremely deformed when fitting with and removing from the mating connector.

(3) According to the fixture for a floating connector claimed in claim 3, said fixture further comprises a second anchoring bent piece between said connection portion and said anchoring bent piece so that said anchoring bent piece and said second anchoring bent piece are located above and below said flange of the insulator, and said fixture further comprises projecting portions located on both sides of said anchoring bent piece between said anchoring bent piece and said second anchoring bent piece and projecting at right angles to said anchoring bent piece for preventing said fixture from falling down. Consequently, the invention can provide a floating connector capable of preventing the fixtures from falling down, and further capable of avoiding the contacts from being buckled or extremely deformed when fitting with and removing from the mating connector.

(4) The floating connector claimed in claim 4 is a floating connector including a plurality of contacts each having a contact portion adapted to contact a mating object, a first fixed portion to be fixed to an insulator, a second fixed portion to be fixed to a housing, an elastic portion provided between said first fixed portion and said second fixed portion and having at least one snaked portion, and a first connection portion to be connected to a substrate; the insulator arranging and fixing said contacts, having flanges, and being supported only by said contacts so as to be in a floating state in said housing; and the housing covering said insulator and arranging and fixing said contacts, wherein the fixtures claimed in any one of claims 1 to 3 are used in said floating connector. Accordingly, the invention can provide a floating connector capable of avoiding the contacts from being buckled or extremely deformed when fitting with and removing from the mating connector.

The invention will be more fully understood by referring to the following detailed specification and claims taken in connection with the appended drawings.

DESCRIPTION OF THE PREFERRED EMBODIMENTS

Figure 1A:
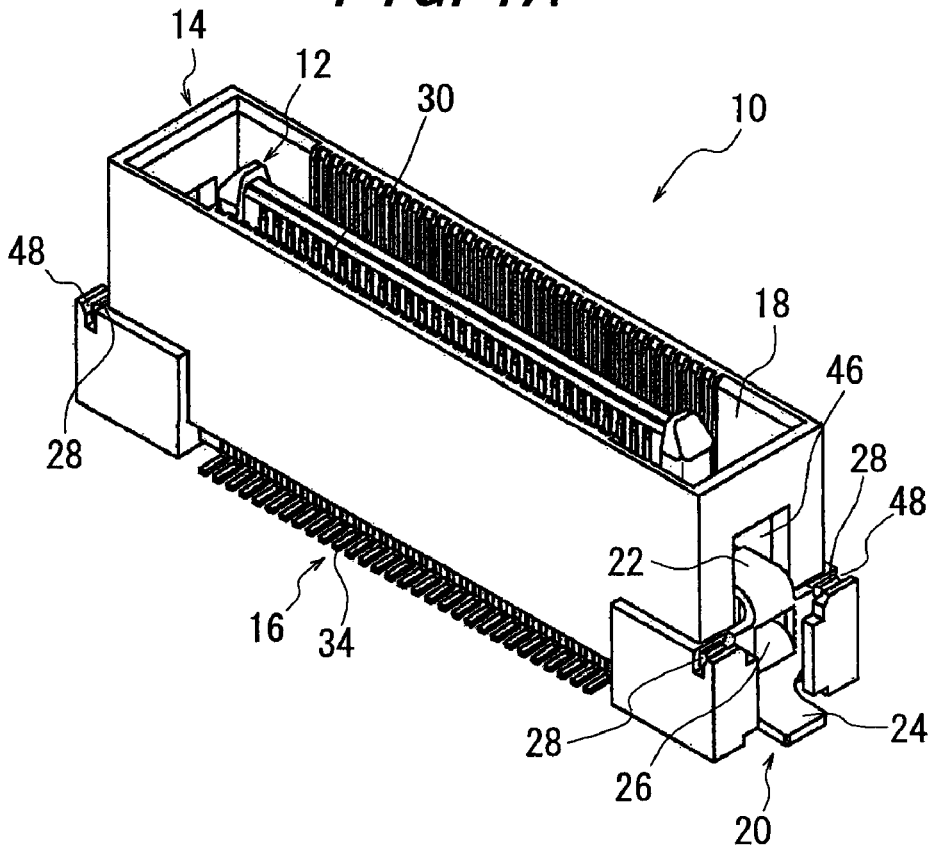
FIG. 1A is a perspective view of the floating connector viewed from the side of fitting.

A subject matter of the invention lies in the fixture 20 for a floating connector, to be mounted on a substrate, having at one end a connection portion 24, and being used in the floating connector 10 including a plurality of contacts 16, an insulator 12 fixing said contacts 16 and having flanges 42, and a housing 14 covering said insulator 12 and fixing said contacts 16, said fixture 20 comprising at the other end an anchoring bent piece 22 adapted to engage one of the flanges 42 of said insulator 12 to prevent said insulator 12 from floating upwardly to an excessive extent. Another subject matter of the invention lies in the floating connector 10 using said fixtures 20.

In other words, the floating connector 10 uses the fixtures 20 to be mounted to the substrate so that each of the flanges 42 of said insulator 12 under a floating condition (by supporting the insulator 12 only by the contacts 16) is arranged between the two anchoring bent pieces 22 and 26 of one fixture 20, with the result that said insulator 12 is prevented from floating upwardly to an excessive extent, thereby preventing buckling and extreme deformation of the contacts, and further that the floating amount of the insulator in the direction of its height is limited and the insulator 12 is prevented from being sunk below the allowable lowest position.

Figure 1B:
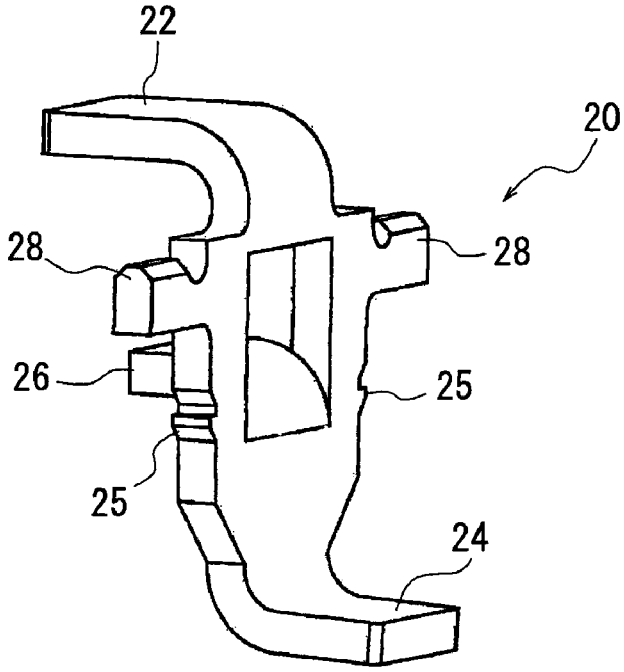
FIG. 1B is a perspective view of the fixture for the floating connector.
Figure 2A:
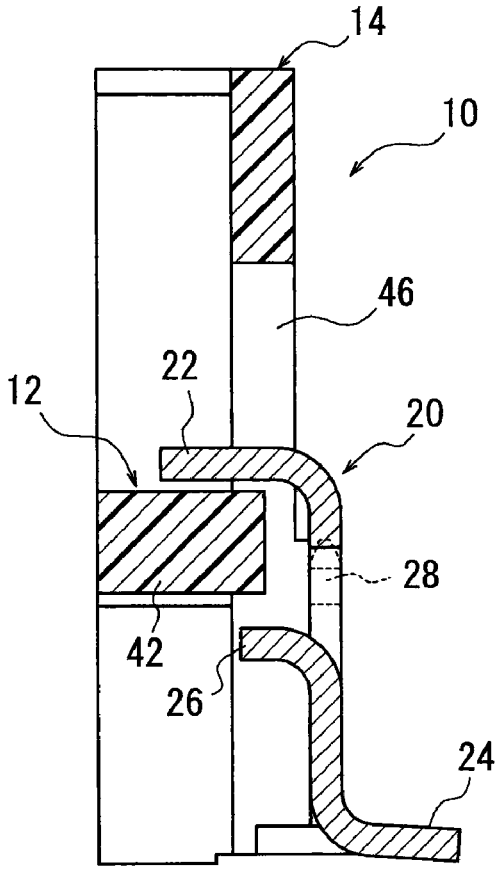
FIG. 2A is a partly cross-sectional view of the connector taken along the fixture.
Figure 2B:
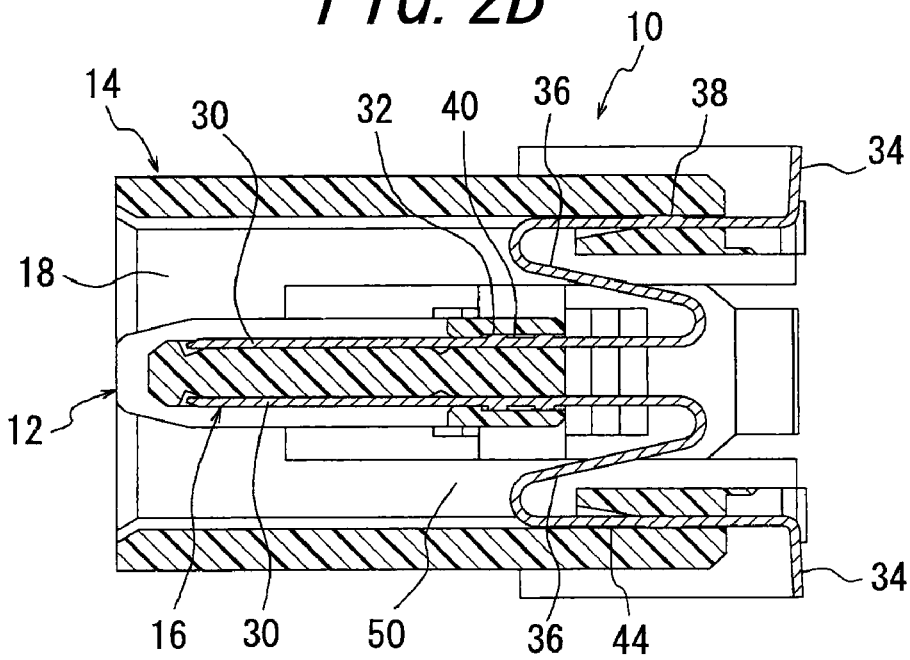
FIG. 2B is a longitudinal-sectional view of the connector taken along one contact.
Figure 3A:
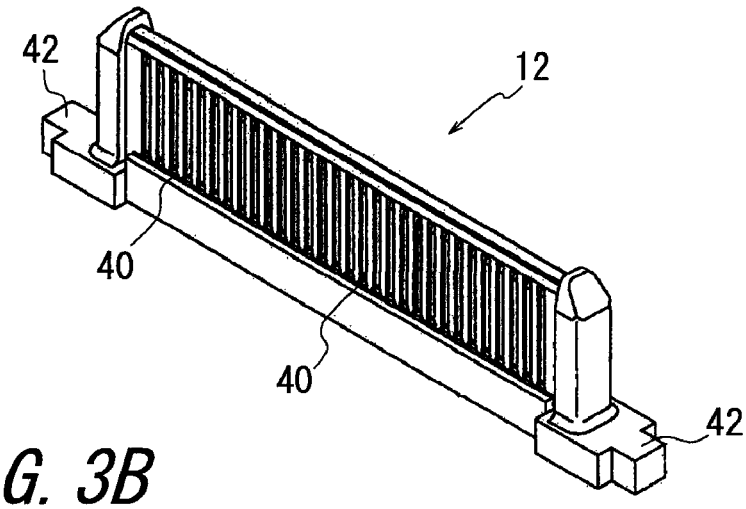
FIG. 3A is a perspective view of the insulator.
Figure 3B:
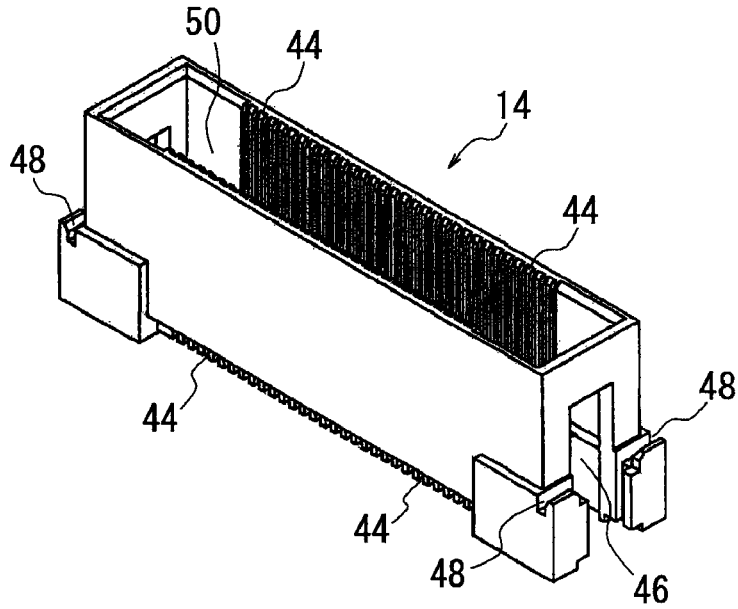
FIG. 3B is a perspective view of the housing.
Figure 3C:
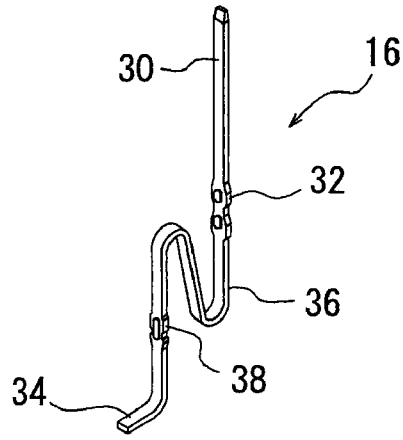
FIG. 3C is a perspective view of the contact.

One embodiment of the fixture 20 and one embodiment of the floating connector 10 using the fixtures 20 according to the invention will then be explained with reference to the drawings. FIG. 1A is a perspective view of the floating connector viewed from the side of fitting, and FIG. 1B is a perspective view of the fixture for the floating connector. FIG. 2A is a partly cross-sectional view of the floating connector taken along the fixture, while FIG. 2B is a longitudinal sectional view of the floating connector taken along one contact. FIG. 3A is a perspective view of an insulator, while FIG. 3B is a perspective view of a housing and FIG. 3C is a perspective view of a contact.

The floating connector (referred to hereinafter as "connector") 10 according to the invention comprises an insulator 12, a housing 14, contacts 16, and fixtures 20 for the floating connector. The connector 10 further comprises a fitting opening 18 into which a mating connector is inserted. Said fitting opening 18 only needs to receive the mating connector therein and may be suitably designed in consideration of the shape and size of the mating connector, strength of the connector 10, and the like.

The fixture 20 for the floating connector (referred to hereinafter as "fixture") will be explained, which is one subject feature of the invention. Said fixture 20 is made of a metal and formed by means of the press-working of the known technique. Preferred metals from which to form said fixture 20 include brass, beryllium copper, phosphor bronze and the like which comply with the requirements as to strength, springiness, solderability, and the like. Said fixture 20 mainly comprises at one end a connection portion 24 to be connected to a substrate, at the other end an anchoring bent piece 22 adapted to restrain a flange 42 of the insulator 12 (to engage the flange 42), a second anchoring bent piece 26 positioned between said anchoring bent piece 22 and said connection portion 24 so that said bent anchoring portion 22 and said second bent anchoring portion 26 are located above and below the flange 42 of the insulator 12, respectively, and projecting portions 28 located between said anchoring bent piece 22 and said second anchoring bent piece 26 to extend perpendicularly to said anchoring bent piece 22 on both sides thereof. These respective portions will be explained hereafter.

The connection portion 24 at the one end of the fixture 20 is to be fixed to the substrate and may be any shape (type) so long as it can be fixed to the substrate. The connection portion 24 in the shown embodiment is of a surface mounting type (SMT). The shape and size of said connection portion 24 may be suitably designed taking into account the mounted density of the connection portions 24 on the substrate, strength, solderability, and the like. For example, a dip type may be used.

Said anchoring bent piece 22 engages the flange 42 of said insulator 12 to prevent the insulator 12 from floating upwardly to an excessive extent when a mating connector is being removed from the connector 10. Said anchoring bent piece 22 is bent substantially at right angles to the main part of the fixture 20 in order to engage the flange 42 of said insulator 12. The shape and size of said anchoring bent piece 22 may be any ones insofar as it can engage the flange 42 of the insulator 12 to perform its function and may be suitably designed in consideration of its function and strength and miniaturization of the connector, engageability, and the like. The shape may be, for example, triangular, rectangular, square, or elongated (not shown).

Said fixture 20 is provided with the second anchoring bent piece 26 between said anchoring bent piece 22 and said connection portion 24 so that said bent anchoring portion 22 and said second bent anchoring portion 26 are located above and below the flange 42 of the insulator 12, respectively. The second anchoring bent piece 26 is provided to locate the flange 42 of said insulator 12 in a floating state (because of the insulator 12 being supported only by the contacts 16) between said anchoring bent piece 22 and said second anchoring bent piece 26 so that the floating amount of the insulator in the direction of its height is limited and at the same time the insulator 12 is prevented from being lowered to an excessive extent or being sunk below an allowable lowest position. The shape and size of the second anchoring bent piece 26 may be any ones so long as it contacts the bottom surface of the flange 42 of said insulator 12 to perform its functions, and may be suitably designed in consideration of its functions, strength, miniaturization of the connector, and the like. The second anchoring bent piece 26 is formed by bending a part of the fixture 20 substantially at right angles to the main part of the fixture 20 so as to contact the bottom surface of the flange 42 of said insulator 12. In other words, when a mating connector is inserted into the fitting opening 18 to push said insulator 12, the bottom surface of the flange 42 of said insulator 12 comes into contact with said second anchoring bent piece 26, thereby preventing the insulator 12 from lowering to an excessive extent to be sunk below the lowest position. The shape of the second anchoring bent piece 26 may be, for example, triangular, rectangular, square, or elongated (not shown).

The distance between said anchoring bent piece 22 and said second anchoring bent piece 26 may be suitably designed taking into account the required floating amount in the direction of the height. The distance between the two anchoring pieces 22 and 26 is 1.7 to 2.0 mm in the case of the flange 42 having a thickness of 1.25 mm in the shown embodiment.

Said fixture 20 is provided with fixed portions 25 on both sides of the width direction in the proximity of the second anchoring bent piece 26 for fixing the fixture 20 to said housing 14. Said fixed portions 25 only need to enable the fixture 20 to be fixed to said housing 14 and may be suitably designed in consideration of the holding force, strength, and the like. The fixture 20 is fixed to the housing by press-fitting the fixed portions 25 into the housing in the illustrated embodiment.

Said fixture 20 is further provided with projecting portions 28 extending at right angles to said anchoring bent piece 22 on both sides thereof between said anchoring bent piece 22 and said second anchoring bent piece 26. Said projecting portions 28 are inserted in recesses 48 of said housing 14 to prevent the fixture 20 from falling down. The shape and size of said projecting portions 28 need only be fitted in the recesses 48 of said housing 14 to perform the above function and may be suitably designed taking into account the function and strength and miniaturization of the connector and the like.

Said insulator 12 and said housing 14 are formed from an electrically insulating plastic material by means of the injection molding of the known technique. The materials for the insulator 12 and the housing 14 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC), polyphenylene sulfide (PPS), and the like and combination thereof. Said insulator 12 and said housing 14 are formed with first inserting holes 40 and second inserting holes 44, respectively, for inserting and fixing a required number of contacts thereinto by press-fitting, hooking (lancing), welding, or the like.

Said insulator 12 will then be explained. Said insulator 12 has a substantially T-shaped cross-section. Said insulator 12 is formed with the first inserting holes 40 of the number equal to that of said contacts 16 for inserting and holding the contacts therein. The shape and size of said first inserting holes 40 may be suitably designed in consideration of the size and shape of the contacts, holding force for the contacts, and the like. The first inserting holes 40 are so shaped that contact portions of mating contacts are able to contact the contact portions 30 of said contacts 16.

Moreover, said insulator 12 has flanges 42 at its longitudinal ends. Said flanges 42 are adapted to engage the anchoring bent pieces 22 and to contact said second anchoring bent pieces 26 of said fixtures 20. The shape and size of said flanges 42 may be any ones insofar as said flanges 42 engage the anchoring bent pieces 22 and contact the second anchoring bent pieces 26 to fulfill the functions, and may be suitably designed in consideration of the functions, strength, miniaturization of the connector, engageability, and the like. The flanges 42 are substantially T-shaped in the illustrated embodiment.

Said housing 14 will then be explained. The housing 14 has a substantially U-shaped cross-section. The housing 14 is formed with the second inserting holes 44 of the number equal to that of said contacts 16 for inserting and holding the contacts 16 therein. The shape and size of said second inserting holes may be suitably designed taking into account the size and shape of the contacts, holding force for the contacts, and the like.

Moreover, said housing 14 is provided with a space 50 for receiving the insulator 12 in a floating manner therein. The shape and size of said space 50 may be any ones so long as said insulator 12 is received in the space so as to permit the floating of the insulator 12. The space 50 is about 0.3 to 1.0 mm larger than the insulator 12 in the illustrated embodiment in consideration of the floating amount.

Said housing 14 is further provided with loading holes 46 for loading the anchoring bent pieces 22 and the second anchoring bent pieces 26 of said fixtures 20 into the space 50 of said housing 14. The shape and size of said loading holes 46 need only allow the anchoring bent pieces 22 and the second anchoring bent pieces 26 to be received in said space 50 and may be suitably designed in consideration of the strength of said housing 14, miniaturization of the connector 10, and the like.

Finally, the contacts 16 will be explained. Said contacts 16 are made of a metal and formed by means of the press-working of the known technique. Preferred metals from which to form said contacts 16 include brass, beryllium copper, phosphor bronze and the like which comply with the requirements as to springiness, electric conductivity, and the like. Said contact 16 mainly comprises a contact portion 30 adapted to contact a mating contact, a first fixed portion 32 to be fixed to said insulator 12, a second fixed portion 38 to be fixed to said housing 14, a first connection portion 34 to be connected to the substrate, and an elastic portion 36 provided between said first and second fixed portions 32 and 38 and having at least one snaked or tortuous portion.

These respective portions of the contact 16 are arranged in the order of the contact portion 30, the first fixed portion 32, the elastic portion 36, the second fixed portion 38, and the first connection portion 34. The respective portions will be explained hereafter. First, the contact portion 30 is adapted to contact the contact portion of a mating contact, and is substantially flat plate-shaped so as to be in line contact with the mating contact at one location. Said contact portion 30 need only be able to contact the mating contact and may be suitably designed taking into account the contact stability, space-saving and reduced overall height of the fitted connector 10, workability, and the like.

Said first fixed portion 32 of the contact 16 is adapted to be held in the first inserting hole 40 of said insulator 12. The first fixed portion 32 is press-fitted in the first inserting hole 40 to be held therein in the illustrated embodiment. The method for holding the fixed portion may be any one so long as the contact 16 is securely held in the insulator 12 and may be suitably designed in consideration of the miniaturization of the connector, strength, holding force for the contact, floatability of the insulator, and the like.

Said elastic portion 36 of the contact 16 serves to hold the insulator 12 in a floating state so that the insulator 12 can be moved in a floating manner. The elastic portion 36 has one snaked or tortuous portion at one location. Said elastic portion 36 is located below said contact portion 30 (on the side of the connection portion 34) and between said first and second fixed portions 32 and 38, and is arranged below said insulator 12 (on the side of the connection portion 34). The number of the snaked portion may be any one insofar as said insulator 12 can move (enables the floating), and may be suitably designed taking into account space-saving and reduced overall height of the fitted connector 10, workability, and the like. The radius of curvature of the snaked portion of the elastic portion 36 may be suitably designed in consideration of space-saving and reduced overall height of the fitted connector 10, workability, and the like. The radius of curvature of the snaked portion of the elastic portion 36 is 0.2 to 0.7 mm in the illustrated embodiment. If the radius of curvature is less than 0.2 mm, the elasticity of the elastic portion 36 becomes insufficient, making it impossible to obtain the required floating of the insulator. On the other hand, if the radius of curvature is more than 0.7 mm, the space-saving of the fitted connector cannot be achieved.

Said second fixed portion 38 of the contact 16 is adapted to be held in the second inserting hole 44 of said housing 14. The second fixed portion 38 is press-fitted in the second inserting hole 44 of the housing 14 in the illustrated embodiment. However, the method for holding the fixed portion 44 may be any other methods insofar as securely holding can be achieved and may be suitably designed in consideration of miniaturization of the connector, strength, holding force for the contact, and the like.

Said first connection portion 34 of the contact 16 is adapted to be connected to the substrate. The shape (or type) of the first connection portion 34 is arbitrary so long as it can be connected to the substrate. Although the first connection portion 34 is of a surface mounting type (SMT) in the illustrated embodiment, it may be of a dip type. Further, said first connection portion 34 is arranged so as not project from said housing 14 taking into account the space-saving.

Examples of applications of the invention are floating connectors for use in electric and electronic appliances for industrial machines, car navigation systems, and the like, and more particularly floating connectors using the fixtures for completely preventing contacts from being buckled and deformed to an excessive extent when fitting with and removing from a mating connector.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A floating connector including a plurality of contacts each having a contact portion adapted to contact a mating object, a first fixed portion to be fixed to an insulator, a second fixed portion to be fixed to a housing, an elastic portion provided between said first fixed portion and said second fixed portion and having at least one snaked portion, and a first connection portion to be connected to a substrate; the insulator arranging and fixing said contacts, having flanges, and being supported only by said contacts so as to be in a floating state in said housing; and the housing covering said insulator and arranging and fixing said contacts, wherein the floating connector comprises fixtures one for each one of the flanges of the insulator to restrict its excessive movement in a vertical direction, wherein the fixtures are to be mounted on the substrate, having at a bottom end a connection portion to be fixed to said substrate, said fixture comprising at a top end a first anchoring bent piece adapted to engage a flange of the insulator to prevent said insulator from floating upwardly to an excessive extent, and said fixture further comprises a second anchoring bent piece between said connection portion and said first anchoring bent piece so that said first anchoring bent piece is located above said flange of the insulator for limiting the floating of said insulator in the direction of its height and said second anchoring bent piece is located below the flange to prevent said insulator from being sunk below the lowest position.

2. The floating connector as claimed in claim 1, wherein an interval between said first anchoring bent piece and said second anchoring piece is 1.7 to 2.0 mm in the case of the flange having a thickness of 1.25 mm.

3. The floating connector as claimed in claim 1, wherein said fixture further comprises projecting portions located on both sides of said first anchoring bent piece between said first anchoring bent piece and said second anchoring bent piece and projecting at right angles to said first anchoring bent piece for preventing said fixture from falling down by coupling with said housing.

4. The floating connector of claim 1, wherein the snaked portion of each contact of the plurality of contacts includes a radius of curvature between 0.2 mm and 0.7 mm.

5. The floating connector of claim 1, wherein the connection portion, the first anchoring bend piece, and the second anchoring bend piece of the fixture are substantially parallel to each other.

6. A floating electrical connector configured to be mounted on a substrate, comprising:

a housing extending around and defining an opening therethrough;

an inner part positioned in the opening, the inner part including at least one flange that extends therefrom;

a plurality of electrical contacts mechanically coupling the housing and the inner part, wherein each electrical contact of the plurality of electrical contacts is configured to be attached to the substrate; and a fixture including:

a body;

a first connection point that that is coupled to the substrate;

a first anchoring bend piece positioned above the at least one flange of the inner part; and a second anchoring bend piece positioned below the at least one flange of the inner part.

7. The electrical connector of claim 6, wherein the housing and the inner part are made of an electrically insulating material.

8. The electrical connector of claim 6, wherein the inner part is coupled to the housing and the substrate only by the plurality of electrical contacts.

9. The electrical connector of claim 6, wherein the first connection point, the first anchoring bend piece and the second anchoring bend piece extend substantially perpendicularly from the body of the fixture.

10. The electrical connector of claim 6, wherein the first anchoring bend piece and the second anchoring bend piece extend into the opening of the housing from the body of the fixture.

11. The electrical connector of claim 6, wherein the flange includes one of brass, berrylium copper, and phosphor bronze.

12. The electrical connector of claim 6, wherein the second anchoring bend piece is positioned between the first anchoring bend piece and the first connection point.

13. The electrical connector of claim 6, wherein a spacing between the first anchoring bend piece and the second anchoring bend piece is 1.7 mm to 2.0 mm.

14. The electrical connector of claim 6, wherein each electrical contact of the plurality of electrical contacts includes a first fixed portion that is coupled to the inner body, a second fixed portion that is coupled to the housing and a substrate attachment portion that is configured to be attached to the substrate.

15. The electrical connector of claim 14, wherein each electrical contact of plurality of electrical contacts further includes a snaked portion positioned between the first fixed portion and the second fixed portion, the snaked portion having a radius of curvature between 0.2 mm and 0.7 mm.

16. The electrical connector of claim 6, wherein the inner part has a substantially T-shaped cross-sectional shape.

17. The electrical connector of claim 6, wherein the inner part and the housing each includes a cavity that houses an electrical contact of the plurality of electrical contacts therein.

* * * * *